US008734563B2

(12) United States Patent
Hanneman et al.

(10) Patent No.: US 8,734,563 B2
(45) Date of Patent: May 27, 2014

(54) METHOD AND PLANT FOR THE PRODUCTION OF ZINC DUST

(75) Inventors: Michael Hanneman, Nigel (ZA); Roy William Heslop, Rivonia (ZA)

(73) Assignee: Zinchem, a division of Zimco Group (Pty) Ltd., Benoni (ZA)

( * ) Notice: Subject to any disclaimer, the term of this patent is extended or adjusted under 35 U.S.C. 154(b) by 349 days.

(21) Appl. No.: 13/057,564

(22) PCT Filed: Aug. 6, 2009

(86) PCT No.: PCT/IB2009/053420

§ 371 (c)(1),
(2), (4) Date: Mar. 2, 2011

(87) PCT Pub. No.: WO2010/016020

PCT Pub. Date: Feb. 11, 2010

(65) Prior Publication Data

US 2012/0031234 A1 Feb. 9, 2012

(30) Foreign Application Priority Data

Aug. 7, 2008 (ZA) ..... 2008/06828

(51) Int. Cl.
*C22B 19/30* (2006.01)

(52) U.S. Cl.
CPC ..... *C22B 19/30* (2013.01)
USPC ..... 75/367; 75/665

(58) Field of Classification Search
None
See application file for complete search history.

(56) References Cited

U.S. PATENT DOCUMENTS

| | | | | |
|---|---|---|---|---|
| 3,768,995 | A | 10/1973 | Calleja | |
| 4,549,598 | A * | 10/1985 | Gervais et al. | 164/66.1 |
| 5,139,567 | A * | 8/1992 | Matsuoka et al. | 75/500 |
| 5,871,561 | A * | 2/1999 | Okada et al. | 75/658 |
| 2006/0123952 | A1 * | 6/2006 | Wilson et al. | 75/660 |
| 2009/0263728 | A1 * | 10/2009 | Zuraw et al. | 429/344 |

FOREIGN PATENT DOCUMENTS

| | | |
|---|---|---|
| CN | 2244053 | 1/1997 |
| CN | 2607217 | 3/2004 |
| JP | 2007-300631 | 11/2007 |

OTHER PUBLICATIONS

Database WPI Week 198508, Thomson Scientific, 1985-048248, Intr. Metal Neferoas, Sep. 30, 1984, abstract, Fig. 1.
Database WPI Week 198131, Thomson Scientific, 1981-56102D, JP 56 072141, Uchica, Jun. 16 1981, abstract.
International Search Report for International Application No. PCT/IB2009/053420, dated Jul. 28, 2010.

* cited by examiner

*Primary Examiner* — George Wyszomierski
(74) *Attorney, Agent, or Firm* — Barnes & Thornburg LLP

(57) ABSTRACT

A method of production of Zinc dust, which includes melting Zinc products in a melting furnace on a semi-continuous basis, transferring at least a part of the molten Zinc products to a vaporizing furnace, vaporizing the molten Zinc in the vaporizing furnace into Zinc vapor on a substantially continuous basis, transferring Zinc vapor from the vaporizing furnace to a condenser, and condensing the Zinc vapor to form Zinc dust.

4 Claims, 1 Drawing Sheet

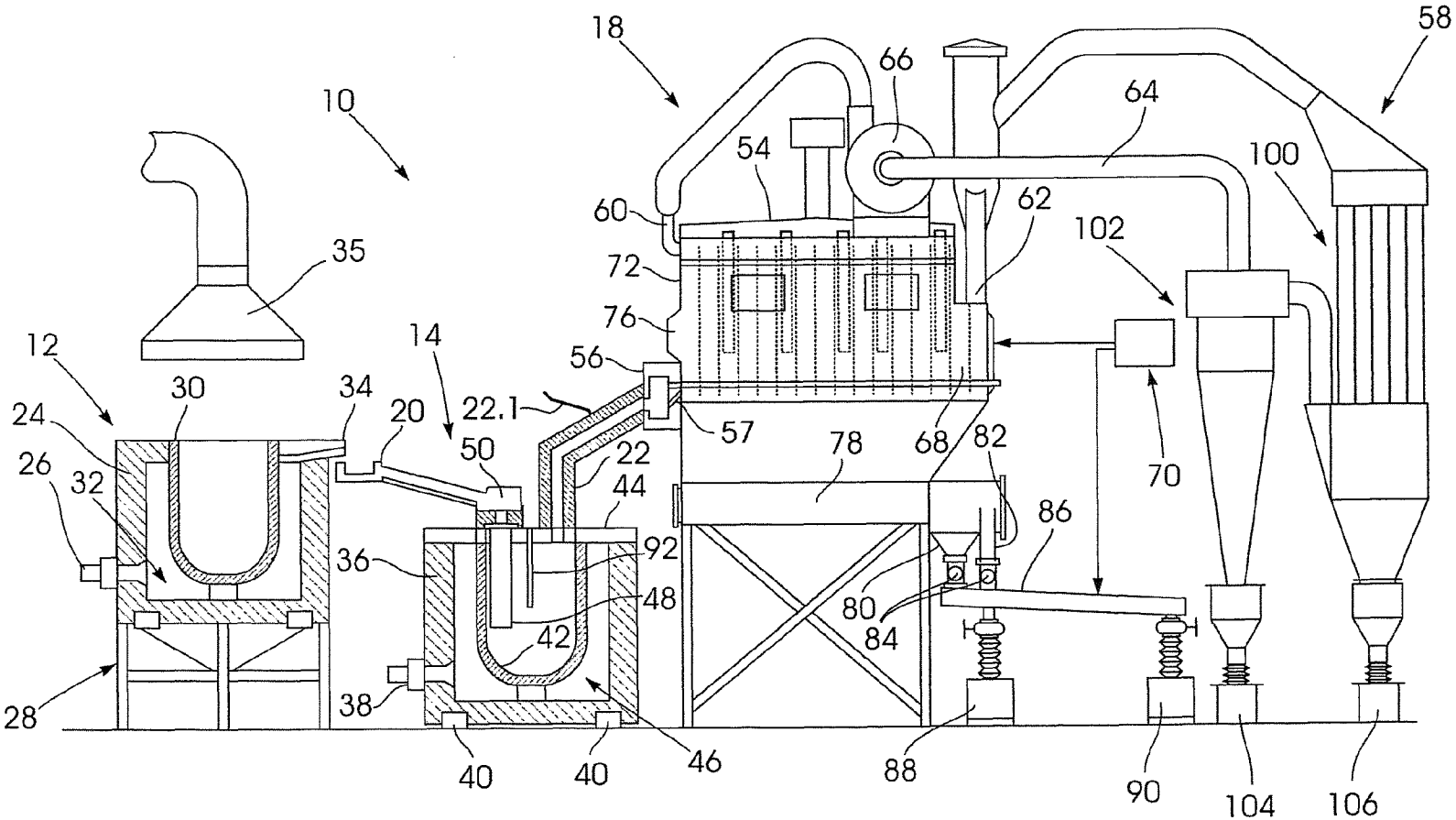
58
100
106
104
90
64
102
70
62
86
82
68
66
88
80
84
78
54
57
18
60
72
76
56
22
44
92
48
46
40
42
22.1
50
14
40
20
36
38
10
34
35
30
12
24
26
32
28

METHOD AND PLANT FOR THE PRODUCTION OF ZINC DUST

This invention relates to the production of Zinc dust. In particular disclosed embodiments relate to a method of producing Zinc dust and to a Zinc dust production plant.

BACKGROUND

An issue with regard to Zinc processing by means of retort furnaces is that conventional furnaces require the production of Zinc dust to be done in batches. However, batch processing of raw materials leads to inefficiencies in the production process.

SUMMARY

The present invention aims to address this inefficiency and to reduce energy consumption. According to a first aspect of the invention, there is provided a method of production of Zinc dust, which includes melting Zinc products in a melting furnace on a semi-continuous basis, transferring at least a part of the molten Zinc products to a vaporizing furnace, vaporizing the molten Zinc in the vaporizing furnace into Zinc vapour on a substantially continuous basis; transferring Zinc vapour from the vaporizing furnace to a condenser; and condensing the Zinc vapour to form Zinc dust.

At least one embodiment may include the prior operation of pre-heating the melting furnace. For example, the melting furnace may be pre-heated to between 400° C. to 700° C. More specifically, the melting furnace may be pre-heated to about 500° C.

At least one embodiment may include the prior operation of charging the melting furnace with Zinc raw materials. The melting furnace may be charged with secondary Zinc products. In particular, the melting furnace may be charged with Zinc top, or bottom dross material from a previous Zinc processing process. At least one embodiment may also include the operation of adding a flux to the molten Zinc in the melting furnace. The flux may be a chloride based flux, for removing vaporizing inhibiting elements, such as aluminium and iron, from the molten Zinc. The temperature of the molten Zinc bath may then be reduced to about 550° C. before transferring the molten Zinc to the vaporizing furnace.

Transferring the molten Zinc to the vaporizing furnace may include the operation of pouring the molten Zinc into a tundish and transporting the molten Zinc by means of a launder to a crucible in the vaporizing furnace. Transferring the molten Zinc to the vaporizing furnace may include the operation of pouring the molten Zinc into the crucible in the vaporizing furnace underneath a surface of previously molten Zinc still remaining in the crucible. Importantly, the newly molten Zinc should be transferred to the crucible without the newly molten Zinc coming into contact with the Oxygen above the surface of the previously molten Zinc in the crucible. The molten Zinc from the melting furnace may be added to the previously molten Zinc in the crucible via a dip tube.

At least one embodiment may include the operation of maintaining a bath of molten Zinc in the vaporizing furnace. At least one embodiment may also include the operation of maintaining the temperature of the Zinc bath in the crucible at between 920° C. to 1150° C. In particular, the temperature of the Zinc bath in the crucible may be maintained at about 950° C. The temperature of the molten Zinc may be maintained by means of a closed loop temperature control system.

Vaporizing the molten Zinc in the vaporizing furnace may include the operation of maintaining the molten Zinc bath in the crucible in the vaporizing furnace at a pre-defined level. The molten Zinc bath may be maintained at a level that exceeds the level of the lower extreme of a dip tube, so as to isolate the atmosphere in the vaporizing crucible from the free atmosphere outside the vaporizing furnace.

At least one embodiment may also include the operation of generating a first alarm if the level of molten Zinc in the crucible falls below a first predefined level. The first alarm may provide and indication that more molten Zinc should be added to the crucible in the vaporizing furnace. At least one embodiment may include the operation of generating a second alarm if the level of molten Zinc in the crucible falls below a second predefined level. The second alarm may provide an indication that the lower extreme of the dip tube may possibly be exposed. As a safety measure, the second alarm may cause the burner in the vaporizing furnace to shut down. Furthermore the first and second alarms may include any one of audible and visual indicators.

Transferring Zinc vapour from the vaporizing furnace to a condenser may include the operation of collecting Zinc vapour in the sealed vaporizing furnace at a level above the surface of the molten Zinc in the crucible. Transferring Zinc vapour to the condenser may include transporting the Zinc vapour from the vaporizing furnace to the condenser via a crossover tube. Transferring Zinc vapour to the condenser may include distributing the Zinc vapour in the condenser by means of a vapour distribution manifold.

Condensing the Zinc vapour to form Zinc dust may include circulating the Zinc vapour in the condenser. The operation of circulating the Zinc vapour in the heat exchanger may result in Zinc condensing in the condenser in particle sizes that are determined by the Zinc vapour circulation speed.

At least one embodiment may include cooling the Zinc vapour by means of air cooling, and in particular by circulating the Zinc vapour through an air cooler.

At least one embodiment may include extracting fine Zinc dust particles from Zinc vapour by means of a cyclone.

Condensing the Zinc vapour may include the operation of maintaining a predefined percentage of Oxygen in the condenser atmosphere. The percentage of Oxygen in the condenser atmosphere may be maintained at a level of about 2%. At least one embodiment may thus include monitoring the percentage Oxygen by means of an Oxygen detector, by purging the condenser atmosphere with an inert gas if the level of Oxygen exceeds the predefined level and by bleeding air from free atmosphere into the condenser atmosphere if the level of Oxygen falls below the predefined level. In particular, the inert gas may be Nitrogen.

At least one embodiment may include transporting Zinc dust from a condenser to a dust collection arrangement. The Zinc dust may be transported to the dust collection arrangement by means of a hopper and screw conveyor.

According to another aspect of disclosed embodiments, there is provided a Zinc dust production plant, which includes a vertical crucible melting furnace into which Zinc products are receivable; a vertical crucible vaporizing furnace into which molten Zinc products from the melting furnace are receivable for vaporizing Zinc; a condenser in fluid flow communication with the vaporizing furnace for receiving Zinc vapour into the condenser, the condenser operable to condense the vaporized Zinc into Zinc dust.

The Zinc dust production plant may include molten Zinc material transport means for transporting heated liquid material from the melting furnace crucible to the vaporizing furnace crucible. The molten material transport means includes a tundish and launder combination.

The melting furnace may include a refractory lining at least partially surrounding the vertical melting crucible. The melting furnace may include a gas-fired burner in heat flow communication with an outside of the melting crucible.

At least a portion of the melting crucible body may be enclosed by the refractory lining, with the gas-fired burner being arranged in a chamber defined between the refractory lining and the melting crucible body. The melting crucible may be of Silicon Carbide.

The melting furnace may include manipulation means for manipulating the melting furnace. The manipulation means may be in the form of tilting means for tilting the melting furnace to cause liquid material in the melting furnace to flow from the melting crucible. The manipulation means may include a hydraulic actuator for tilting the melting furnace.

The melting furnace may include pouring means in the form of a spout for directing liquid flow from the melting furnace.

The vaporizing furnace may include a refractory lining at least partially surrounding the vertical vaporizing crucible. The vaporizing furnace may also include a gas-fired burner in heat flow communication with an outside of the vaporizing crucible.

A portion of the vaporizing crucible body may be enclosed by the refractory lining, with the gas-fired burner being arranged in a chamber defined between the refractory lining and the melting crucible body. The vaporizing crucible may be of Silicon Carbide.

The vaporizing furnace may include a dip tube extending into a lower portion of the vaporizing crucible, the top end of the dip tube being in flow communication with the molten material transport means and the bottom end of the dip tube opening into the lower portion of the vaporizing crucible. A level above the bottom end of the dip tube defines an operative lower working level for molten material in the vaporizing crucible.

The refractory lining may enclose the sides of the vertical vaporizing crucible and a top cover may seal the top ends of the refractory lining and the vaporizing crucible, thereby defining a burner chamber between the outside of the vaporizing crucible and an inside of the refractory lining and defining a vaporizing chamber inside the vaporizing crucible.

The dip tube may extend through the top cover into the vaporizing crucible.

The vaporizing furnace may include measurement means for measuring the amount of heated liquid in the vaporizing crucible. The measurement means may be the form of weight measurement means such as load cells onto which the vaporizing furnace may be mounted. The measurement means may be in the form of level measurement means such as a dipstick protruding into the vaporizing crucible.

The Zinc dust production plant may include vapour transport means in the form of a crossover tube having at a first end an opening through the top cover of the vaporizing crucible and a second end leading into the condenser. The crossover tube may include a heating element.

The condenser may be defined by an enclosure of steel plate. The condenser may include a screw conveyor arrangement at a bottom of the enclosure, operable to extract solids collecting at the bottom of the enclosure. The condenser may include a vapour distribution manifold connected to a second end of the vapour transport tube, the vapour distribution manifold opening into the inside of the enclosure.

The condenser may include a circulation system having an extractor at one end of the enclosure by means of which vapour may be extracted from the enclosure and an inlet at another end of the enclosure by means of which extracted vapour may be returned to the inside of the enclosure. The circulation system may include at least one cooling cyclone for cooling the vapour.

The condenser may include an atmosphere control arrangement for controlling the Oxygen content in the vaporizing chamber. The atmosphere control arrangement may include an Oxygen detector disposed in the inside of the enclosure, an inert gas purging arrangement, an air bleed arrangement and a processor controllably connected to the inert gas purging arrangement and the air bleed arrangement, operable, if the oxygen content exceeds a predefined level, to reduce the oxygen content in the enclosure by purging the inside with an inert gas from the inert gas purging arrangement and, if the oxygen content falls below a predefined level, to increase the oxygen content in the enclosure by opening the air bleed so as to form a thin oxide coating on the dust particle that renders it passive to any reaction.

Disclosed embodiments extends to a method of controlling Zinc dust particle size in a Zinc vapour condenser by adjusting a speed of circulation of Zinc vapour in the condenser to obtain a desired Zinc dust particle size.

BRIEF DESCRIPTION OF THE FIGURES

Disclosed embodiments will now be described, by way of example only with reference to the following drawing(s):

FIG. 1 shows a Zinc dust production plant in accordance with disclosed embodiments.

DETAILED DESCRIPTION OF DISCLOSED EMBODIMENTS

In FIG. 1, a Zinc dust production plant 10 is shown. The plant 10 includes a vertical crucible melting furnace 12, a vertical crucible vaporizing furnace 14 and a condenser 18. Molten material transport means in the form of a tundish and launder 20 is provided between the melting furnace 12 and the vaporizing furnace 14. Vapour transport means in the form of a Silicon Carbide crossover tube 22 is provided between the vaporizing furnace 14 and the condenser 18.

The melting furnace 12 comprises a refractory lining 24, with a gas burner 26 protruding through the lining 24 with the burner on an inside of the lining 24. The refractory lining is mounted on a hydraulic actuated tilt table 28. Inside the lining 24 a Silicon Carbide melting crucible 30 is provided with an open end exposed to free atmosphere. A burner chamber 32 is defined between the outside wall of the melting crucible 30 and the inside of the refractory lining 24. A pouring spout 34 is provided from the crucible 30 over a top edge of the refractory lining 24. The melting furnace 12 is provided with an extraction system 35.

The pouring spout 34 is in alignment with the tundish and launder, 20 so that contents of the melting crucible 30 will flow via the spout 34 into the tundish and launder 20 when the tilt table 28 tilts the refractory lining 24.

The vaporizing furnace 14 comprises a refractory lining 36, with a gas burner 38 protruding through the lining 36. The gas burner is provided on an inside of the lining 36. The refractory lining 36 is mounted on load cells 40 operable to measure the total weight of the vaporizing furnace. In other embodiments the amount of material in the vaporizing furnace 14 can be determined with manual measurement means, such as a dip stick, or the like. Inside the lining 36 a Silicon Carbide vaporizing crucible 42 is provided with an open end facing upwards. A furnace top cover 44 seals the top of the refractory lining 36 and the vaporizing crucible 42 to define a closed burner chamber 46 and to close the top of the vaporizing crucible 42. A Silicon Carbide dip tube 48 protrudes through the top cover 44 leading from a funnel assembly 50 to an inside of the vaporizing crucible 42. One end of the crossover tube 22 protrudes through the top cover 44 and opens into the top of the vaporizing crucible 42. The tundish and launder 20 is in alignment with the funnel assembly 50 so that liquid flowing down the tundish and launder 20 will flow into the funnel assembly 50 and into the vaporizing crucible 42. The crossover tube 22 includes an electrical heating element (of which only the connection is shown as 22.1) integral with the tube 22 for maintaining the temperature in the tube at 900° C. to prevent any condensation in the crossover tube 22.

The condenser 18 is defined by a steel plate chamber/enclosure 54 with a heat exchanger in the form of a vapour circulation system 58. The condenser 18 includes a vapour distribution manifold 56 in flow communication with another end of the crossover tube 22. The vapour distribution manifold 56 and vapour distribution manifold nozzles 57 are arranged to distribute vapour from the vaporizing furnace into the chamber 54. The condenser includes a vapour circulation system 58 having an extractor 62 at one end of the enclosure by means of which vapour may be extracted from the chamber 54 and a return flow inlet 60 at another end of the chamber 54 by means of which extracted vapour may be returned to the inside of the enclosure. A cooler/collector 100 is provided downstream of the extractor 62 and is connected via ducting to a cyclone 102 and via a second duct 64 to a circulation fan 66 and back to the return flow inlet 60. Two collection bins 106 and 104 are provided at discharge points at the bottom of the cooler/collector 100 and the cyclone 102 respectively. Two surge hoppers with pneumatically operated dual flap valves (not shown) are provided between the cooler/collector 100 and the collection bin 106, and the cyclone 102 and the collector 104, respectively. The dual flap valves are controlled to open and close at predefined intervals. An Oxygen detector 68 is provided to monitor the Oxygen content on the inside of the chamber 54. An inert gas purging system 70, using Nitrogen as gas is provided with outlets into the chamber 54. An air bleed 72 is provided into the chamber 54. The Oxygen detector 68, the Nitrogen purging system 70 and the air bleed 72 are controllably connected to a SCADA control system (not shown) for controlling the Oxygen content in the inside of the chamber 54. It is to be appreciated that any inert gas purging system can be used instead of the Nitrogen system. A nozzle cleaning system 76 is provided to clean the vapour distribution manifold nozzles 57.

At the bottom of the chamber 54 a screw conveyor 78, is provided to move solids/Zinc dust collected at the bottom of the chamber 54 out of the chamber 54. The screw conveyor 78 has a built in screening arrangement that is attached to screw conveyor shaft.

At an outlet end of the conveyor 78 two discharge points are provided 80, 82. The discharge point 80 discharges solids with a size smaller than 0.5 mm and the discharge point 82 discharges solids with a size larger than 0.5 mm. Two pneumatically operated dual falp valves 84 are provided to control the outlet from the discharge points 80, 82.

A cooling screw conveyor 86 is provided with an inlet from the discharge point 80.

Two solid/dust collection bins 88, 90 are provided to collect solids from the discharge point 82 and from an outlet of the screw conveyor 86, respectively.

In operation, the melting furnace 12 is pre-heated to a temperature of between 400° C. and 700° C. by means of the gas burner 26. The melting crucible 30 is then charged with Zinc raw materials such as secondary Zinc waste metal. In particular the crucible 30 can be charged with top dross Zinc.

The melting furnace 12 is then brought up to a temperature of between 920° C. and 1150° C. and a chloride-based flux is added to the bath of molten Zinc. The temperature of the molten bath of Zinc is allowed to drop to 550° C.

The molten material is transferred to the vaporizing furnace 14 by tilting the refractory 24 by means of the hydraulic tilt table 28 and pouring the molten material via the spout 34 into the tundish and launder 20. The molten material is allowed to flow into the vaporizing furnace 14 through the funnel assembly 50 and dip tube 48. Initially the vaporizing crucible is filled to a level exceeding the bottom end of the dip tube 48, but once in operation the molten material in the vaporizing crucible is controlled never to drop below the bottom end of the dip tube 48. Therefore, once in operation the material will always be added below the surface of the material in the vaporizing crucible 42. This is important not to allow oxygen containing air to enter the free space above the level of molten Zinc in the vaporizing furnace 14.

A thermocouple 92 disposed on the inside of the vaporizing crucible 42 connected to a SCADA control system and the burner 38 is used to control the temperature of the bath of molten material in the vaporizing crucible. Furthermore, the level of molten material in the vaporizing crucible 42 is measured by measuring the weight of the vaporizing furnace 14 with the load cells 40, or by means of mechanical measurement means such as a dipstick. The level is to be maintained above a predefined first set-point and if the level drops below the predefined first set-point, an alarm indicated that more molten material should be added to the vaporizing crucible. If the level drops below a second set-point an alarm indicates that the system is shutting down. The burner is then shut down to allow the material in the vaporizing furnace to cool down.

In operation Zinc vapour from the vaporizing furnace 14 is transferred to the condenser 18 via the crossover tube 22. The vapour enters the condenser chamber 54 via a vapour distribution manifold 56 and vapour distribution nozzles 57. The nozzles 57 distribute the vapour inside the chamber 54. The nozzles 57 are provided with pneumatically operated nozzle wipers (not shown) and with a pneumatically operated nozzle-opening needle (not shown) to clear the nozzles at predefined time intervals.

Inside the condenser chamber 54, the vapour is cooled with the vapour circulation system 58 and forms Zinc dust that drops out to the bottom of the chamber 54.

The vapour circulation system cools the vapour by extracting the vapour from the chamber 54 via the extractor 62, which is provided with an explosive discharge at its top. From the extractor 62, the vapour is transported to a cooler/collector 100, which is in the form of a radiator that cools the vapour and allows Zinc dust in the vapour to collect at the bottom of the cooler/collector 100 and, via the pneumatically operated dual flap valves, in the collection bin 106.

The vapour is then transported to the cyclone 102, where fine particles are separated from the vapour to be collected at the bottom of the cyclone 102 and, via the pneumatically operated dual flap valves, in the collection bin 104. This bin collects the finest Zinc dust particles.

The Zinc dust, collected at the bottom of the chamber 54 is then transported by means of the screw conveyor 78 and is sorted into smaller particles and larger particles by means of a built in screening arrangement that is fixed to the screw conveyor shaft. The dust drops out in two discharge points 80, 82. The smaller particles drops out into discharge point 80 and the larger particles drop out into discharge point 82 into a collection bin 88. The smaller particles are conveyed from the discharge point 80 via the cooling screw conveyor to a collection bin 90.

The Oxygen content in the condenser is controlled by means of the Nitrogen purging system 70, the air bleed 72, the Oxygen detector 68, and the SCADA control system (not shown).

The particle size of the Zinc particles may be controlled via the vapour circulation system 58. To increase the particle size, the vapour is circulated slower, and to decrease the particle size, the vapour is circulated faster.

The disclosed embodiments provide utility in that Zinc dust can be produced on a semi-continuous basis and the system is sealed from Oxygen in free air, which provides for easier process control. Furthermore the controllability of the particle size is of particular importance and the particle size may be easier to control in accordance with the disclosed embodiments. A finer particle size can be obtained with the invention and the consistency of the particle size is better controlled. Disclosed embodiments provide additional utility in that they may provide an energy consumption reduction of about 50% compared to existing Zinc dust production plants. Furthermore, the disclosed embodiments may provide an improvement in the yield when compared to existing plants.

The invention claimed is:

1. A method of production of Zinc dust, which comprises pre-heating a melting furnace to a temperature of between 400° C. to 700° C.;

melting Zinc products in the melting furnace to form molten Zinc products;

reducing the temperature of the molten Zinc products to about 550° C.;

transferring at least a part of the molten Zinc products to a vaporizing furnace using molten material transport means being in flow communication with the vaporizing furnace and a dip tube with a top end of the dip tube being in flow communication with the molten material transport means and a bottom end of the dip tube extending into a the crucible in the vaporizing furnace;

maintaining the molten Zinc products in the vaporizing furnace at a pre-defined level above the bottom end of the dip tube;

vaporizing the molten Zinc products in the vaporizing furnace into Zinc vapour;

transferring Zinc vapour from the vaporizing furnace to a condenser; and condensing the Zinc vapour to form Zinc dust.

2. The method of claim 1, in which transferring the molten Zinc products to the vaporizing furnace further comprises the step of pouring the molten Zinc products into the crucible in the vaporizing furnace underneath a surface of previously molten Zinc products still remaining in the crucible.

3. The method of claim 1, in which condensing the Zinc vapour to form Zinc dust further comprises circulating the Zinc vapour in the condenser and cooling the Zinc vapour by means of air cooling.

4. The method of claim 3, which further comprises controlling Zinc dust particle size, by adjusting the circulation speed of the Zinc vapour in the condenser.

* * * * *